US006263532B1

(12) United States Patent
Miller

(10) Patent No.: US 6,263,532 B1
(45) Date of Patent: Jul. 24, 2001

(54) METHODS AND APPARATUS FOR REFURBISHING BEDDING MATTRESSES

(75) Inventor: R. Scott Miller, Buford, GA (US)

(73) Assignee: Simmons Company, DE (US)

( * ) Notice: Subject to any disclaimer, the term of this patent is extended or adjusted under 35 U.S.C. 154(b) by 0 days.

(21) Appl. No.: 09/504,411

(22) Filed: Feb. 15, 2000

(51) Int. Cl.[7] ..... A47C 27/00
(52) U.S. Cl. ..... 5/690; 5/737; 5/738; 29/91.1
(58) Field of Search ..... 5/737, 738, 690; 29/91, 91.1

(56) References Cited

U.S. PATENT DOCUMENTS 3,950,800 * 4/1976 Garshfield ..... 5/738
4,424,600 * 1/1984 Callaway ..... 5/738
4,449,261 * 5/1984 Magnusson ..... 5/738
5,414,882 * 5/1995 Goodale ..... 5/738
5,475,881 * 12/1995 Higgins et al. ..... 5/737
6,088,858 * 7/2000 Juster et al. ..... 5/737

FOREIGN PATENT DOCUMENTS

243262 * 8/1960 (AU) ..... 5/738

* cited by examiner

*Primary Examiner*—Alexander Grosz
(74) *Attorney, Agent, or Firm*—Smith, Gambrell & Russell, LLP

(57) ABSTRACT

A cover for a tight top mattress includes an upper panel, a lower panel and a border panel. A zipper connects the border panel to either the upper or lower panel. At least one of the upper of lower panels is a quilted foam and fabric assembly which is dimensioned and configured as a pillow top. The upper, lower and border panels define an enclosure for closely fitting and receiving the mattress.

7 Claims, 3 Drawing Sheets

METHODS AND APPARATUS FOR REFURBISHING BEDDING MATTRESSES

BACKGROUND OF THE INVENTION

1. Field of the Invention

The present invention relates generally to methods and apparatus for refurbishing bedding mattresses and for extending the effective life of used bedding mattresses. More particularly, it relates to mattress covers which are structured and dimensioned to receive and tightly enclose conventional tight top bedding mattresses and to methods for employing such mattress covers to convert tight top mattresses into pillow top mattresses and to extend the usable life of the mattresses by renewing the comfort and feel and enhancing the appearance of the mattresses.

2. Description of the Related Art

Conventional bedding mattresses having what is generally known as tight top construction have long been in widespread use in virtually every area of the world. Typically, such mattresses include a core assembly which may be constructed of a plurality of coil springs with predetermined resilience. The springs are often covered with an upholstery layer which may include one or more layers of foam. The upholstery layer normally is covered with a sewn quilt layer which may include foam, fiber, ticking and other material.

In more recent times, a form of mattress has become popular known as a "pillow top" mattress. The pillow top mattress generally is constructed using a standard mattress core, but has a raised V-shaped fabric border sewn around its edges to which a separate quilted pillowlike layer, typically including fiber and/or foam and ticking is attached. The pillow top construction adds a degree of enhanced comfort for the user and, thus, it has become accepted as a somewhat higher quality mattress over conventional tight top mattress products. An example of an adjustable firmness mattress pillow top is disclosed in U.S. Pat. No. 4,424,600 issued to Callaway and assigned to the common assignee herein.

It has been common practice to replace mattresses after they have become soiled and/or worn in appearance as a result of usage of the mattress over an extended period of time. However, mattress replacement is normally rather expensive, particularly in the case of high volume consumers of bedding equipment such as institutional users such as hotels and similar hospitality enterprises where multiple sleeping accommodations are offered to the public.

Accordingly, it would be desirable to provide a means for refurbishing a used mattress so that its useful life can be significantly extended. Furthermore, it would be desirable to provide such a means which could be used conveniently to renew a mattress. Still further, it would be desirable to provide such a means which has the additional advantage of converting a conventional tight top mattress into a pillow top mattress.

SUMMARY OF THE INVENTION

The present invention improves over the prior wait by providing a cover for a tight top mattress including an upper panel, a lower panel and a border panel. A zipper arrangement connects the border panel to either the upper or the lower border panel. At least one of the upper or lower panels is a quilted foam and fabric assembly which is structured and dimensioned as a pillow top. The upper, lower and border panels define an enclosure for closely fitting and receiving an existing mattress construction.

BRIEF DESCRIPTION OF THE DRAWING

The foregoing and other novel features and advantages of the invention will be better understood upon a reading of the following detailed description taken in conjunction with the accompanying drawing wherein.

DETAILED DESCRIPTION OF THE PREFERRED EMBODIMENTS

Figure 1:
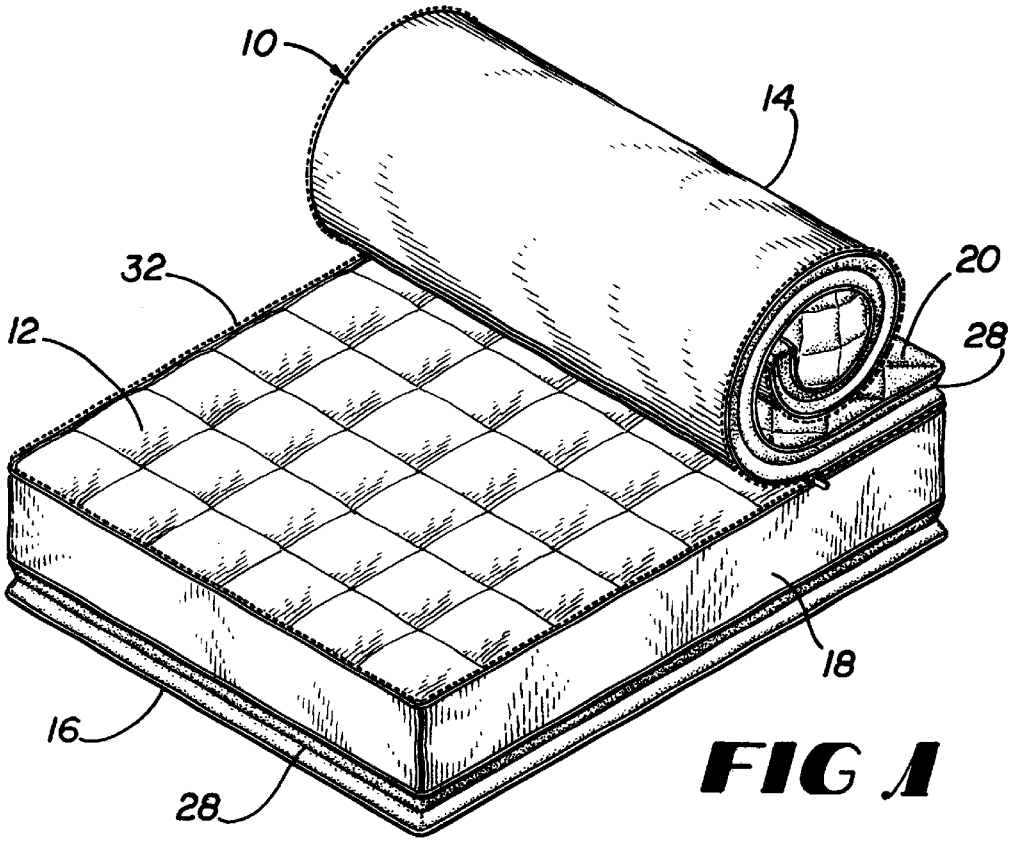
FIG. 1 is a front side perspective of a mattress cover constructed in accordance with the principles of the present invention shown as installed on a mattress.
Figure 2:
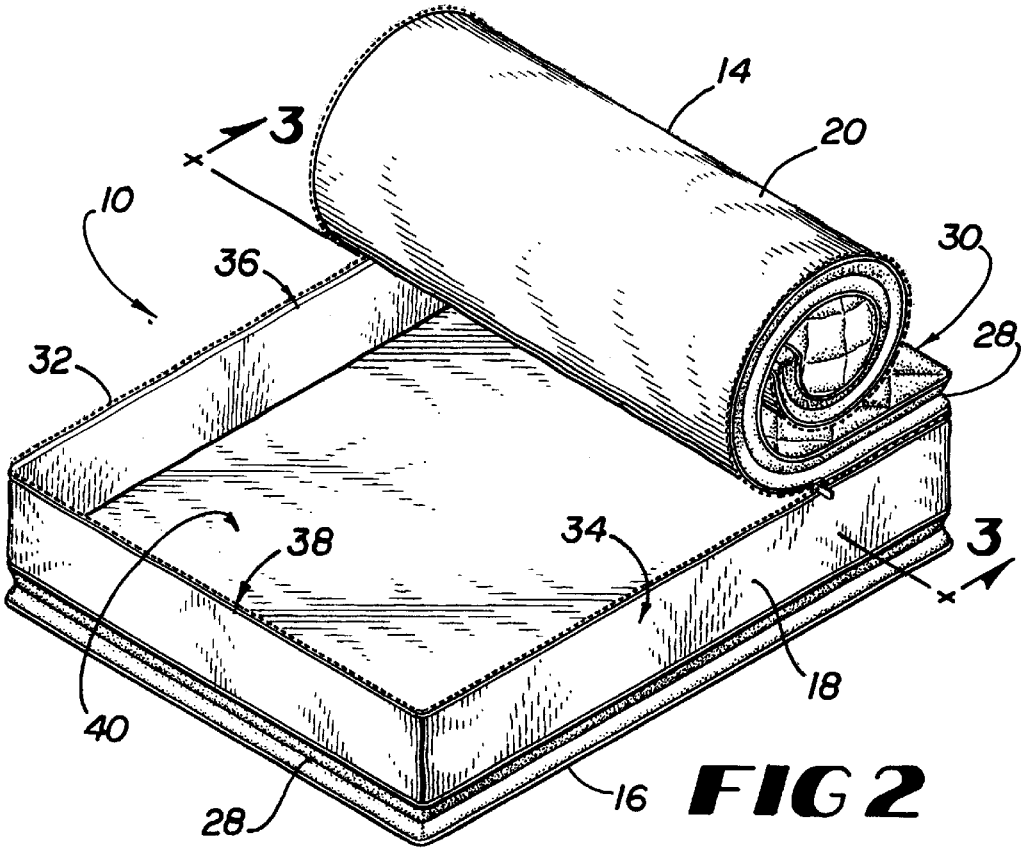
FIG. 2 is a front side perspective view of one form of the cover illustrated without a mattress.
Figure 3:
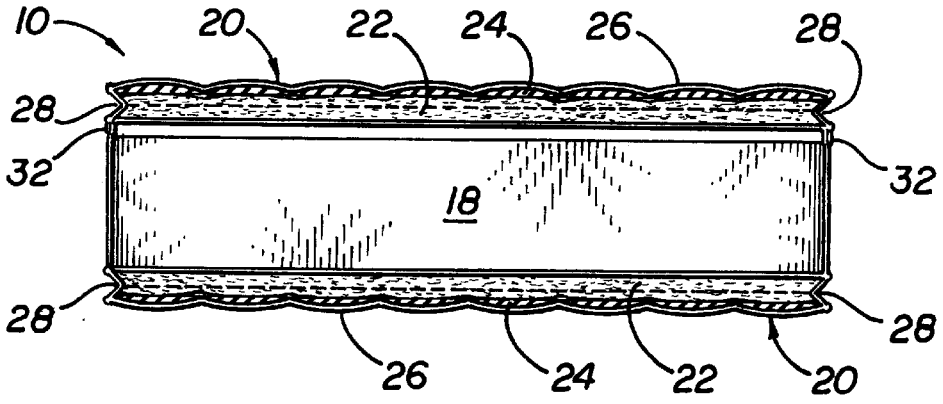
FIG. 3 is a cross-sectional view taken substantially along the line 3–3 of FIG. 2.

Referring now to the drawing, FIGS. 1 and 2 illustrate a mattress cover constructed according to the invention and designated generally by the numeral 10 for enclosing a conventional tight top mattress 12. The cover 10 includes as its principal components an upper panel 14, a lower panel 16 and a border panel 18. In a preferred form, the upper and lower panels 14 and 16 arc both constructed in the form of a conventional pillow top assembly. To this end, both the upper and lower panels 14 and 16 include a quilt assembly 20. As best illustrated in FIG. 3, the quilt assembly 20, preferably, includes a layer of fiber 22 such as a hollow filled Dacron fiber, a layer of foam material 24 such as a flat or convoluted foam and an outer layer of ticking material 26 such as damask. In a most preferred embodiment of this invention, the layers 22 and 24 and ticking 26 are all sewn together into a unitary construction comprising the quilt assembly 20.

Also, the quilt assembly 20 includes a V-shaped peripheral edge strip 28 formed from any appropriate fabric. In a preferred embodiment of this invention, the upper panel 14 is connected to the border panel 18 by sewing the V-shaped fabric strip 28 to the border panel 18, for example, at a top or head end 30 of the cover 10 and a zipper arrangement 32 extends around the remaining two sides 34, 36 and bottom or foot end 38 of the cover 10. The lower panel 16 may have a construction similar to the upper panel 14 but can simply be sewn to the border panel 18 with a V-shaped strip 28 without a zipper arrangement. By this construction, a conventional tight top mattress can be inserted into the interior space 40 of the cover 10 and the upper panel 14 can be zippered closed to completely enclose the mattress (see FIG. 2).

Figure 4:
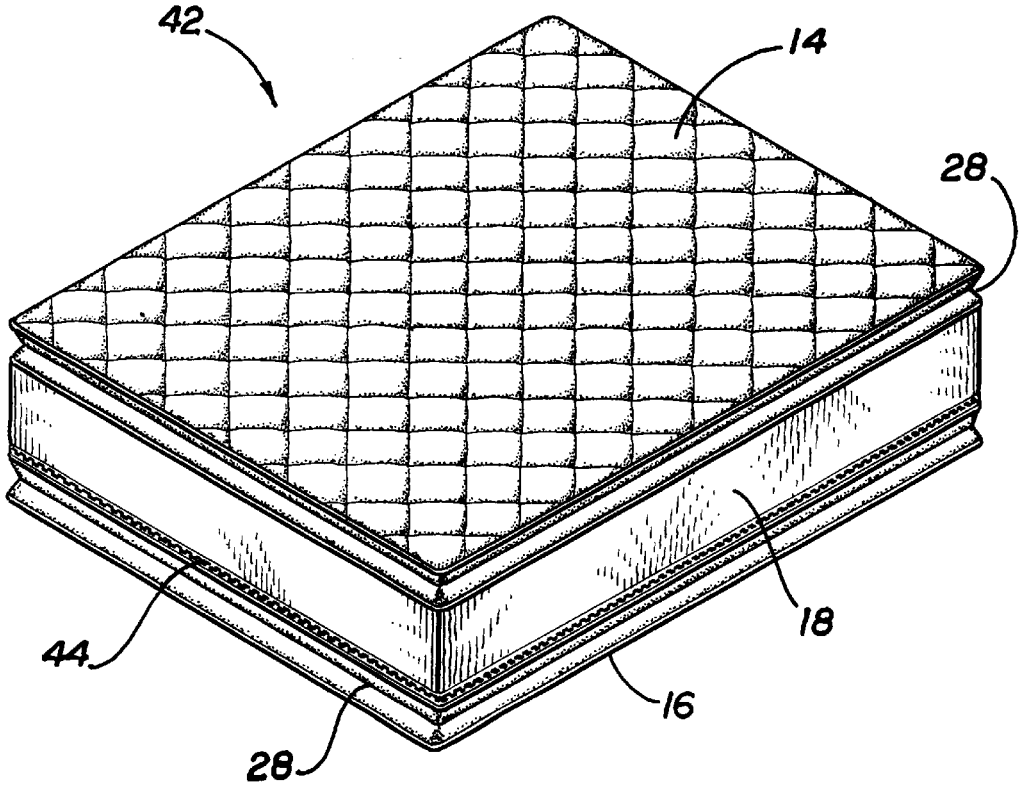
FIG. 4 is a front side perspective view of a mattress and cover shown fully assembled and with a zipper reversed from that shown in FIGS. 1 and 2.

FIG. 4 illustrates a completed assembly of a mattress cover 42 fully enclosing a mattress (not shown). However, in this embodiment the upper panel 14 is sewn around its edges to the border 18 with intermediate strip 28, while the lower panel, only the edge of which can be seen, is sewn to a zipper 44 and an intermediate strip 28. Like the embodiment of FIGS. 1–3, the zipper 44 need only extend around the sides and foot of the cover 42.

Figure 5:
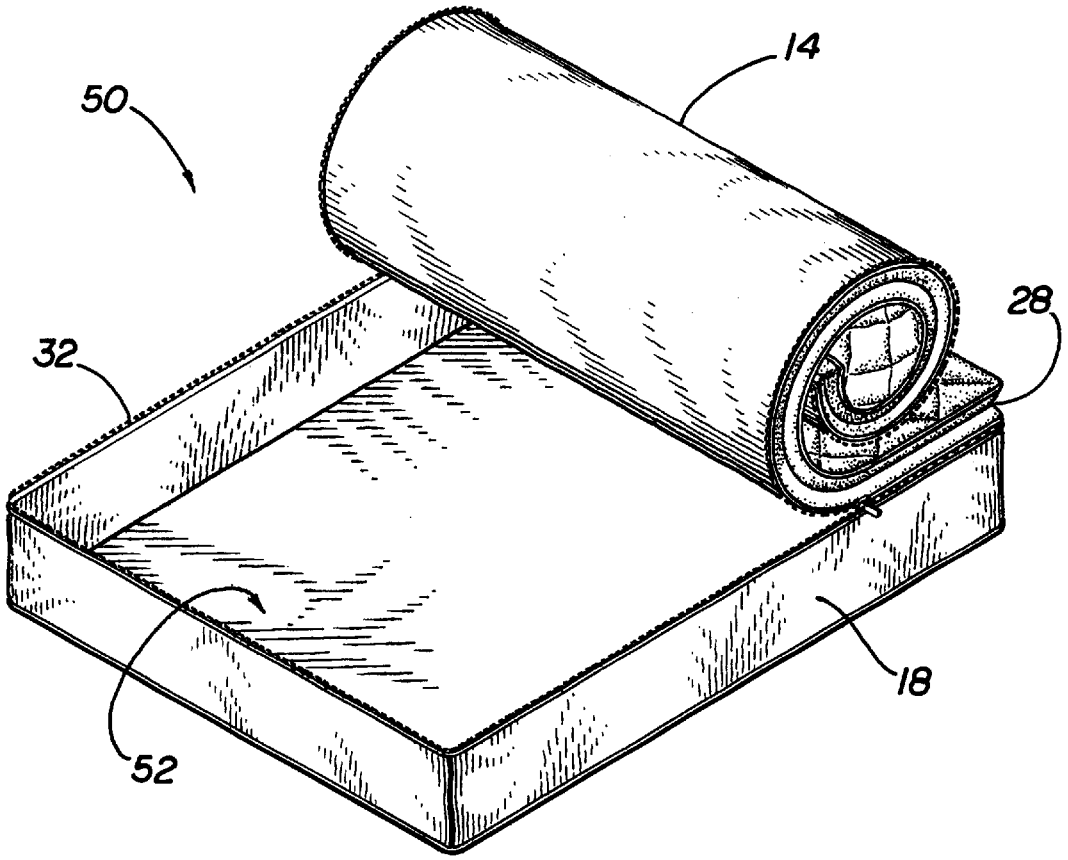
FIG. 5 is a front side perspective view of an alternative cover having a pillow top assembly only on the upper side of the mattress.

FIG.5 illustrates a further embodiment of a mattress cover 50 wherein the tipper panel 14 is constricted as a pillow top assembly as heretofore described. However, bottom panel 52 is only a single fabric layer, such as ticking, sewn directly to the border 18 without a pillow top assembly.

It can now be appreciated that a cover constructed as illustrated and described offers considerable advantages in converting a standard tight top mattress to a reversible pillow top mattress having enhanced comfort and visual appeal. Preferably, the cover is dimensioned as to snugly fit the enclosed mattress which may have standard twin, queen or king size dimensions. While the cover may be used to renew a used tight top mattress thereby extending its useful life, it is also advantageously used to simply convert any age tight top mattress to a pillow top mattress if the user desires. Although the illustrated covers 10 and 42 are shown with pillow top panels on both its upper and lower sides for mattress reversibility, it will be appreciated that only one side need have a pillow top construction if desired.

While the invention has been described in connection with preferred embodiments, it will be apparent to those skilled in the art that many changes and modifications may be made without departing from the true spirit and scope of the invention. Accordingly, it is intended by the appended claims to cover all such changes and modifications as come within the spirit and scope of the invention.

What is claimed is:

1. A cover assembly for refurbishing a tight top bedding mattress, the mattress having a top surface, a bottom surface and side walls interconnecting the top and bottom surfaces, the cover assembly comprising:

a) a first quilted foam and fabric cover panel assembly;

b) a second cover panel assembly;

c) a border cover panel assembly located between said first and second cover panel assembly;

d) a generally V-shaped fabric edge portion located between said border cover panel assembly and said first panel assembly; and e) a zipper assembly connecting said V-shaped fabric edge portion and said border cover panel assembly, wherein the first and second cover panel assembly and the border cover panel assembly define an enclosure for receiving and closely fitting about the top and bottom surfaces of the mattress.

2. The cover assembly of claim 1 wherein the zipper extends around three sides of the border cover panel assembly.

3. A cover assembly for refurbishing a tight top bedding mattress, the mattress having a relatively planar top surface, a relatively planar bottom surface and side walls interconnecting the top and bottom surfaces, the cover assembly comprising:

a) a first quilted foam and fabric cover panel assembly;

b) a second quilted foam and fabric cover panel assembly;

c) a border cover panel assembly located between said first and second quilted foam and fabric cover assembly;

d) a first V-shaped fabric edge portion located between said border cover panel assembly and said first cover panel assembly;

e) a zipper assembly connecting said first V-shaped fabric edge portion with said border cover panel assembly in a manner such that the first and second cover panel assembly and the border cover panel assembly define an enclosure for receiving and closely fitting about the top surface, sidewalls and bottom surface; and f) a second V-shaped fabric edge portion located between said border cover panel assembly and said second cover panel assembly.

4. The cover assembly of claim 3 wherein the zipper extends around three sides of the border cover panel assembly.

5. A method for converting a tight top mattress to a pillow top mattress comprising the steps of:

providing a cover having an upper panel, a lower panel, a border panel located between said upper panel and lower panel, and a V-shaped fabric edge portion located between said border panel and said upper panel, wherein a zipper at least partially connects the V-shaped fabric edge to the border panel and wherein the upper panel is formed as a pillow top assembly;

inserting a tight top mattress into the cover with the upper panel open and with the sides of the mattress aligned with similarly dimensioned panel of the cover; and closing the zipper to completely enclose the mattress within the cover.

6. The method of claim 5 wherein both the upper panel and lower panel are formed as pillow top assemblies.

7. The method of claim 5 wherein the zipper extends around three sides of the cover.

* * * * *

UNITED STATES PATENT AND TRADEMARK OFFICE

CERTIFICATE OF CORRECTION

PATENT NO. : 6,263,532 B1
DATED : July 24, 2001
INVENTOR(S) : Miller, R. Scott

It is certified that error appears in the above-identified patent and that said Letters Patent is hereby corrected as shown below:

Column 1,
Line 29, change "popular" to -- popularly --.
Line 59, change "wait" to -- art --.

Column 2,
Line 1, change "DRAWINGS" to -- DRAWINGS --.
Lines 5, and 23, change "drawing" to -- drawings --.
Line 64, change "tipper" to -- upper --.
Line 64, change "constricted" to -- constructed --.

Signed and Sealed this

Fifth Day of February, 2002

*Attest:*

*Attesting Officer*

JAMES E. ROGAN
*Director of the United States Patent and Trademark Office*